US008641237B2

(12) United States Patent
Chuang

(10) Patent No.: US 8,641,237 B2
(45) Date of Patent: Feb. 4, 2014

(54) LED LIGHT BULB PROVIDING HIGH HEAT DISSIPATION EFFICIENCY

(76) Inventor: Sheng-Yi Chuang, Hsinchu (TW)

( * ) Notice: Subject to any disclaimer, the term of this patent is extended or adjusted under 35 U.S.C. 154(b) by 64 days.

(21) Appl. No.: 13/370,141

(22) Filed: Feb. 9, 2012

(65) Prior Publication Data

US 2013/0208474 A1 Aug. 15, 2013

(51) Int. Cl.

| | |
|---|---|
| ***F21V 29/00*** | (2006.01) |
| ***F21S 9/00*** | (2006.01) |
| ***F21V 17/00*** | (2006.01) |

(52) U.S. Cl.
USPC ..... 362/294; 362/249.04; 362/249.02; 362/249.06; 362/373

(58) Field of Classification Search
USPC ..... 313/11–46; 362/294, 373, 249.02
See application file for complete search history.

(56) References Cited

U.S. PATENT DOCUMENTS

| | | | | |
|---|---|---|---|---|
| 6,621,222 | B1 * | 9/2003 | Hong | 362/249.14 |
| 8,247,976 | B2 * | 8/2012 | Chuang | 362/249.02 |
| 2007/0159828 | A1 * | 7/2007 | Wang | 362/294 |
| 2008/0062703 | A1 * | 3/2008 | Cao | 362/311 |
| 2009/0052186 | A1 | 2/2009 | Xue | |
| 2009/0303736 | A1 | 12/2009 | Yen | |
| 2010/0295439 | A1 * | 11/2010 | Oechsle et al. | 313/46 |
| 2011/0068692 | A1 | 3/2011 | Tian et al. | |
| 2011/0163681 | A1 * | 7/2011 | Dau et al. | 315/294 |
| 2011/0181164 | A1 * | 7/2011 | Lin | 313/46 |
| 2011/0273072 | A1 * | 11/2011 | Oki | 313/46 |

FOREIGN PATENT DOCUMENTS

| | | |
|---|---|---|
| TW | I293807 | 2/2008 |
| TW | M345944 | 12/2008 |
| TW | M358247 | 6/2009 |
| TW | M381743 | 6/2010 |

* cited by examiner

*Primary Examiner* — Mariceli Santiago
(74) *Attorney, Agent, or Firm* — Muncy, Geissler, Olds & Lowe, PLLC

(57) ABSTRACT

An LED light bulb includes a lamp shell, a light emitting assembly and a power receiving base. The lamp shell includes a light transmissive portion and a holding portion. The light emitting assembly includes a light source baseboard located in the light transmissive portion and a circuit board connecting to the light source baseboard. The circuit board is surrounded by a heat sink. The heat sink includes a heat collecting section and a holding section extended from the heat collecting section into the power receiving base such that the power receiving base fully encases the heat sink without exposing. The inner surface of the power receiving base connects to the outer surface of the holding section so that heat generated by the light source baseboard is absorbed by the heat collecting section and transmitted via the holding section to the power receiving base for dissipating.

11 Claims, 4 Drawing Sheets

LED LIGHT BULB PROVIDING HIGH HEAT DISSIPATION EFFICIENCY

FIELD OF THE INVENTION

The present invention relates to an LED light bulb and particularly to an LED light bulb providing high heat dissipation efficiency.

BACKGROUND OF THE INVENTION

Light emitting diode (LED) provides many advantages over the traditional tungsten light bulb, such as longer lifespan, lower power consumption, higher luminosity and less fabrication materials. These days as energy saving and carbon reduction are growing concerns in the mind of many people, LED has been widely used. Apart from adopted on traffic lights or signal lights on electric appliances, it also gets growing acceptance in general houses. Techniques to couple the LED with the conventional light bulb have been proposed in prior art. For instance, R.O.C. patent No. I293807 entitled "LED light bulb equipped with a constant current circuit" discloses an LED light bulb which includes a lamp cap, a lamp shell, a plurality of LEDs coupled in series and a step-down constant current circuit. The lamp cap has an electrode connecting to a power source. The LEDs are connected to the step-down constant current circuit to provide constant current to allow the LEDs to emit light. The LED light bulb thus formed can be mounted onto a conventional socket and used directly.

However, the luminosity provided by a single LED is still inadequate. Hence the general LED light bulb usually contains multiple LEDs. As a result, the substrate holding the LEDs accumulates a great amount of waste heat. If the waste heat cannot be dissipated efficiently from the substrate to the outside, high temperature affects lighting efficiency of the LEDs, and the lifespan of the LEDs suffers. To address this issue, LED light bulbs equipped with metal heat sink have been developed, such as R.O.C. patent Nos. M345944, M358247 and M381743, and U.S. publication Nos. 2011/0068692 and 2009/0303736. They mainly provide a substrate to hold LEDs and a power receiving base electrically connected to a commercial power source. The substrate and power receiving base are interposed by an exposed heat sink which further holds a driving circuit inside. To improve cooling effect of the heat sink, the heat sink generally is made of metal and contains a plurality of radiation fins.

Aside from the aforesaid technique to dissipate the waste heat via the metal heat sink, another cooling approach also is proposed that transmits the waste heat from the substrate via the heat sink to the power receiving base, such as U.S. publication No. 2009/0052186 which discloses an LED light bulb including a lamp shell, a power receiving base, a heat sink located between the lamp shell and power receiving base, and a substrate. The heat sink has an upper portion coupled with an opening of the lamp shell. The heat sink has a protrusive ring in the middle portion and a thread section at the lower surface to couple with the power receiving base. The waste heat generated by the substrate is transmitted via the heat sink to the power receiving base for dissipating. The cooling structure for the LED thus formed in simpler and straightforward. However, it also has a drawback, i.e. coupling with the lamp shell is accomplished via the heat sink rather then the power receiving base. Hence the protrusive ring is exposed outside the power receiving base. As the LED light bulb has to pass a severe high voltage applying test under an external voltage of 4000 volts, electric power could pass through the protrusive ring and break through insulation of the insulator to damage the conversion circuit in the heat sink and make the LED light bulb fail to pass the safety regulation test. The LED light bulb thus formed has the concern of current leakage through the heat sink when in use.

On the other hand, aluminum has a heat conductivity coefficient up to 237 $Wm^{-1}K^{-1}$ and can be abundantly supplied. Compared with other metals, it also has a higher thermal conductivity and is cheaper. Hence the conventional LED light bulbs generally adopt an aluminum substrate laid with conduction circuits to drive the LEDs to emit light. But most conventional LED light bulbs have the conduction circuits formed merely on one side of the aluminum substrate to allow the aluminum substrate to project light via one surface. To enhance the luminosity of the LED light bulb, one side of the aluminum substrate where the conduction circuits are laid is clustered with a greater number of LEDs. As a result, a greater amount of waste heat is generated and creates a concern of damaging the LEDs.

SUMMARY OF THE INVENTION

The primary object of the present invention is to overcome the concern of current leakage from the heat sink that occurs to the conventional LED light bulb and also provide high heat dissipation efficiency.

To achieve the foregoing object, the present invention proposes an LED light bulb providing high heat dissipation efficiency that includes a lamp shell, a light emitting assembly and a power receiving base. The lamp shell includes a light transmissive portion and a holding portion with an opening located below the light transmissive portion. The light emitting assembly includes at least one light source baseboard located in the light transmissive portion and including at least one light emitting element mounted on the light source baseboard and a circuit board connecting to the light source baseboard. The circuit board is surrounded by a heat sink which has a housing chamber to hold the circuit board.

The power receiving base is electrically connected to the circuit board. The power receiving base has a fastening portion encased the holding portion. The heat sink includes a heat collecting section located in the light transmissive portion and formed at an outer diameter smaller than the inner diameter of the holding portion and a holding section extended integrally from the heat collecting section into the power receiving base. The power receiving base encases the holding portion and fully encases the heat sink without exposing simultaneously. The power receiving base also has an inner surface connecting to an outer surface of the holding section. Thereby heat generated by the light source baseboard is absorbed by the heat collecting section and transmitted via the holding section to the power receiving base for dissipating.

In one embodiment of the invention the holding section is formed at an outer diameter greater than that of the heat collecting section, and the holding portion is extended towards the holding section to form a retaining section that is formed at an outer diameter the same as that of the holding section.

In another embodiment of the invention the light source baseboard is an aluminum baseboard including a plurality of conduction circuits. The light emitting assembly includes a circuit adapter located between the light source baseboard and circuit board. The circuit adapter is coupled on an orifice formed at one side of the housing chamber of the heat sink.

In yet another embodiment the circuit adapter has the surfaces coated with plastics in contact with the light source baseboard and heat collecting section. The housing chamber also is filled with the plastics to hold the circuit board in the housing chamber.

In yet another embodiment the circuit board and heat sink are interposed by an insulation bushing to prevent conductive connection therebetween.

In yet another embodiment the circuit board and heat sink are interposed by plastics to prevent conductive connection therebetween.

In yet another embodiment the plastics are thermal conductive plastics, and the heat sink is made of a material selected from the group consisting of aluminum, copper, iron and graphite.

Another object of the invention is to overcome the disadvantage of the conventional LED light bulbs that one side of the aluminum substrate are laid with conduction circuits to result in deficient luminosity and concentrated waste heat.

To achieve the foregoing object, the invention provides a light source baseboard that is an aluminum baseboard including a plurality of conduction circuits and also has a first surface and a second surface opposite to the first surface. The first and second surfaces both include a plurality of conduction circuits and a plurality of light emitting elements electrically connected to the conduction circuits. Furthermore, the light source baseboard includes a lateral surface connecting to the first and second surfaces. The lateral surface includes a plurality of conduction circuits and a plurality of light emitting elements connected electrically to the conduction circuits.

By means of the technical features set forth above, the invention provides many advantages over the conventional techniques, notably:

1. Higher cooling efficiency. As the heat sink is located outside the circuit board and connected to the inner surface of the power receiving base, and the light source baseboard and heat sink are in contact with the thermal conductive plastics, waste heat generated by the light source baseboard is directly transmitted via the heat sink to the power receiving base for dissipating.

2. Current leakage via the heat sink at high voltages can be averted. As the power receiving base has the fastening portion encasing the holding portion, the power receiving base encases the holding portion and fully encases the heat sink without exposing simultaneously, thus the risk of electric shock to users caused by in contact with the heat sink can be avoided.

3. Over concentration of waste heat can be prevented. Since the light source baseboard is an aluminum baseboard and includes the first and second surfaces at opposite sides both that contain a plurality of conduction circuits and light emitting elements electrically connected to the conduction circuits, the light emitting elements can be mounted onto any surface of the aluminum baseboard to avoid the waste heat from excessively concentrating on one surface thereof.

4. The light bulb can be formed in diversified profiles with varying light emitting fashions. The external profile of the light source baseboard can be designed according to different requirements so that the light emitting elements located thereon can produce various lighting styles. For instance, the light source baseboard can be designed in a form of a Christmas tree to serve as a Christmas ornamental lamp.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
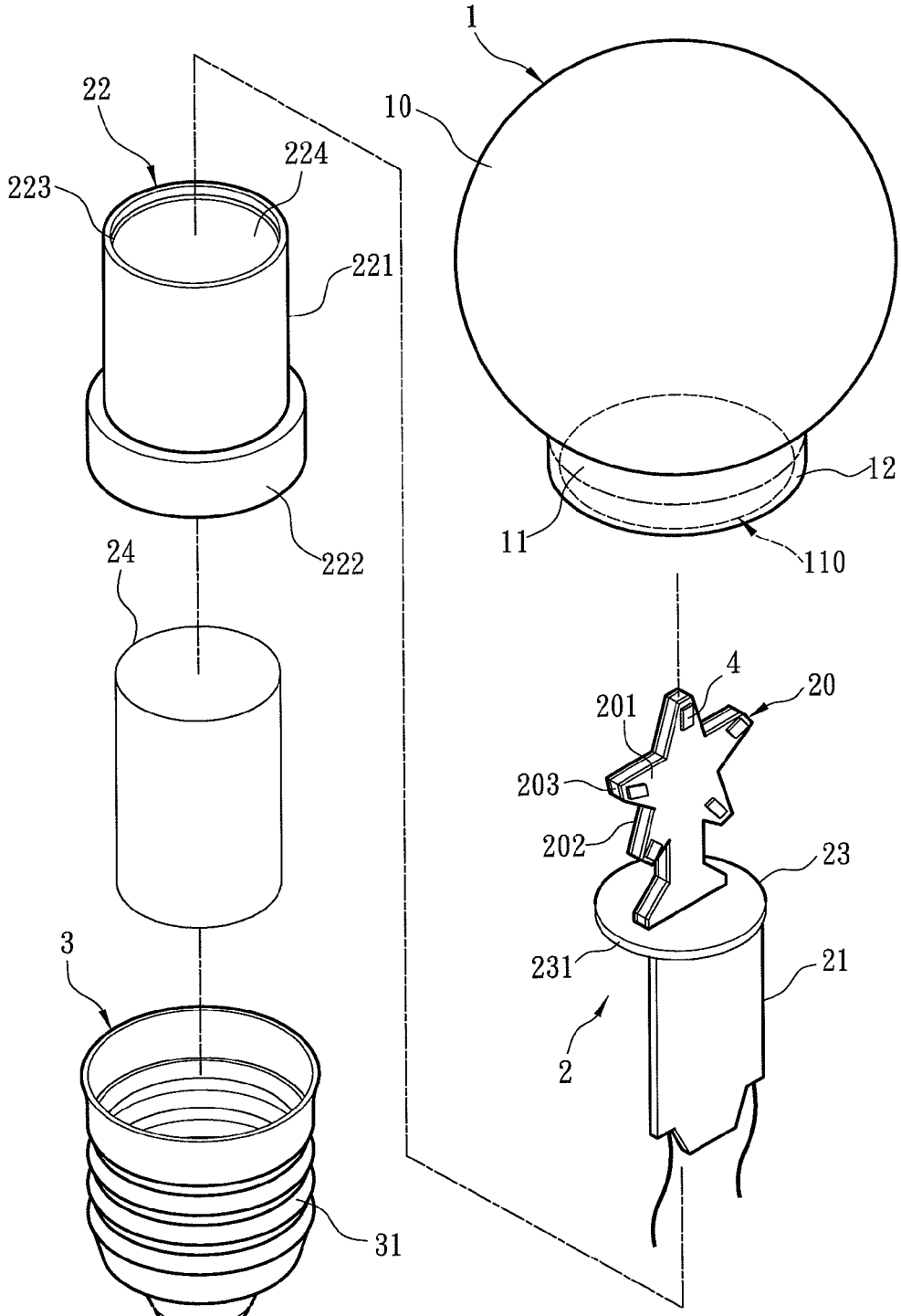
FIG. 1 is an exploded view of the LED light bulb of the invention.

The present invention aims to propose an LED light bulb providing high heat dissipation efficiency. Please referring to FIG. 1, the LED light bulb includes a lamp shell 1, a light emitting assembly 2, a heat sink 22, an insulation bushing 24 and a power receiving base 3. The lamp shell 1 includes a light transmissive portion 10 and a holding portion 11 located below and connected to the light transmissive portion 10. The light transmissive portion 10 forms a space to hold the light emitting assembly 2. The holding portion 11 has an opening 110 and extended to form a retaining section 12.

The light emitting assembly 2 includes at least one light source baseboard 20 located in the light transmissive portion 10 and a circuit board 21 electrically connecting to the light source baseboard 20. The light source baseboard 20 has at least one light emitting element 4 mounted thereon. In this embodiment the light emitting element 4 is a light emitting diode. The light source baseboard 20 is an aluminum baseboard including a plurality of conduction circuits. The light emitting assembly 2 further includes a circuit adapter 23 located between the light source baseboard 20 and circuit board 21. Based on the present techniques, the aluminum baseboard can be formed by stacking an aluminum foil, thermal conductive insulation material and an aluminum plate together. The aluminum foil is etched to form circuits to be embedded in the thermal conductive insulation material and aluminum plate to allow the light source baseboard 20 to include the conduction circuits.

In this embodiment, the aluminum baseboard has two sides laid with conduction circuits. Thus the light source baseboard 20 includes a first surface 201 and a second surface 202 with a plurality of LEDs 4 located thereon. Electric power is supplied to the LEDs 4 via the conduction circuits. To increase projection area of the light source baseboard 20, it further has a lateral surface 203 connecting to the first and second surfaces 201 and 202. The lateral surface 203 also can include a plurality of conduction circuits and a plurality of LEDs 4 connecting to the conduction circuits.

Figure 2:
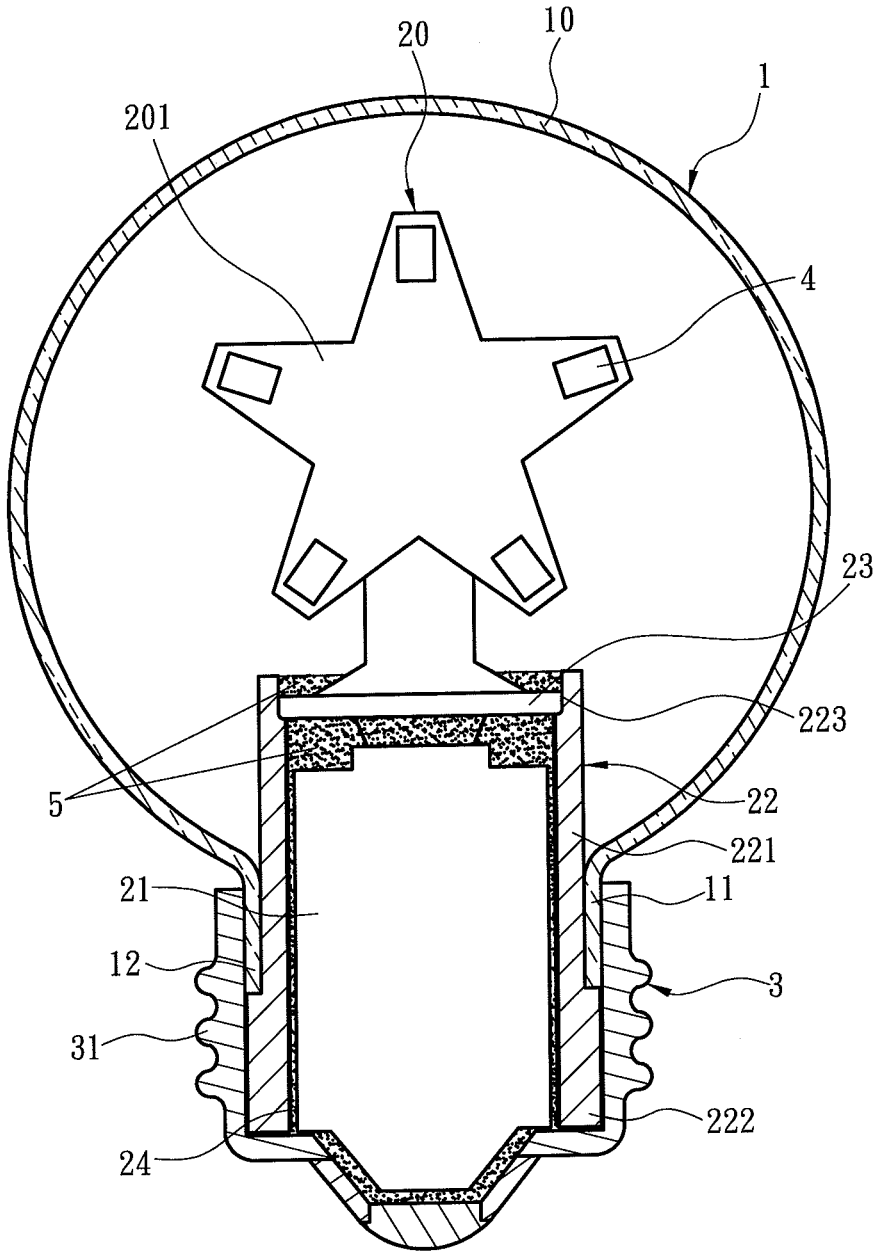
FIG. 2 is a sectional view of the LED light bulb of the invention.

Also referring to FIG. 2, the circuit board 21 has an outer side surrounded by a barrel-shaped heat sink 22. The heat sink 22 can be made of desired conductive material selected from the group consisting of aluminum, copper, iron and graphite. The heat sink 22 includes a heat collecting section 221 located in the light transmissive portion 10 and formed at an outer diameter smaller than the inner diameter of the holding portion 11 and a holding section 222 extended integrally from the heat collecting section 221 into the power receiving base 3. The heat collecting section 221 is extended into the light transmissive portion 10 to hold the light source baseboard 20 in the space of the light transmissive portion 10, with the outer surface of the holding section 222 connecting to the inner surface of the power receiving base 3, such that heat generated by the light source baseboard 20 in the light transmissive portion 10 is absorbed by the heat collecting section 221 and transmitted via the holding section 222 to the power receiving base 3 for dissipating. Preferably, the waste heat generated by the LEDs 4 can be efficiently transmitted via the light source baseboard 20 to the heat collecting section 221. The circuit adapter 23 has the surfaces coated with plastics 5 in contact with the light source baseboard 20 and heat collecting section 221, thus the waste heat generated by the light source baseboard 20 can be transmitted via the plastics 5 to the heat collecting section 221. The plastics 5 are thermal conductive plastics.

Moreover, the heat sink 22 includes a housing chamber 224 (also referring to FIG. 1) to hold the circuit board 21 and an insulation bushing 24 between the circuit board 21 and heat sink 22 to prevent conduction between them. In addition to the aforesaid embodiment, the insulation bushing 24 between the circuit board 21 and heat sink 22 can also be substituted by thermal conductive plastics. Thus, not only conduction between the circuit board 21 and heat sink 22 can be averted, waste heat generated by the circuit board 21 also can be transmitted via the thermal conductive plastics to the heat sink 22, and the circuit board 21 can also be securely held in the housing chamber 224.

In order to securely hold the circuit adapter 23 in the heat sink 22, the heat collecting section 221 has an indent holding groove 223 formed on the inner wall to be wedged in by the circumference of the circuit adapter 23, thereby the circuit adapter 23 an be firmed held in the housing chamber 224 without wobbling. Moreover, the holding section 222 of the heat sink 22 is formed at an outer diameter greater than that of the heat collecting section 221, and the holding portion 11 is extended towards the holding section 222 to form the retaining section 12 that is formed at an outer diameter substantially the same as that of the holding section 222 for butting. Thus relative vertical movement between the lamp shell 1 and heat sink 22 is prohibited.

Figure 3:
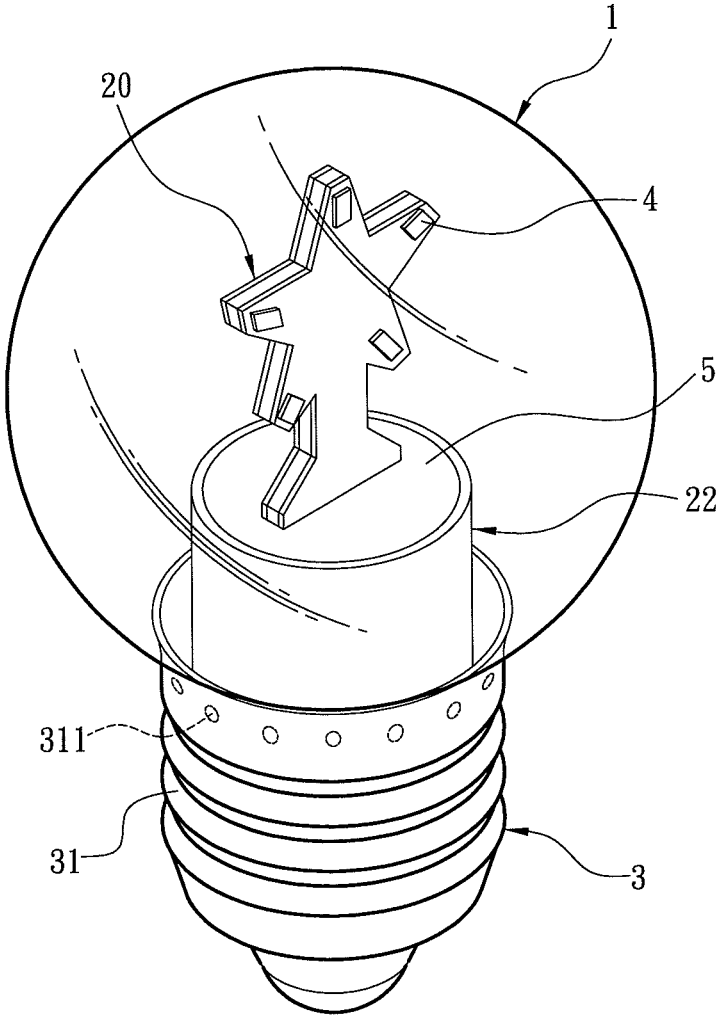
FIG. 3 is a perspective view of an embodiment of the light source baseboard of the invention.

The power receiving base 3 has a fastening portion 31 formed at an outer diameter slightly greater than that of the holding portion 11 to encase and fasten to the holding portion 11. During assembly of the LED light bulb, after the fastening portion 31 and holding portion 11 have been coupled, the fastening portion 31 is held by a mechanical means and a plurality of latch structures 311 (as shown in FIG. 3) are formed on the fastening portion 31 to form secure coupling with the holding portion 11. The power receiving base 3 encases the holding portion 11 and also fully encases the heat sink 22 without exposing simultaneously, hence is different from the conventional LED light bulb that the heat sink is exposed to outside to perform cooling. Thus, in the invention, the heat sink 22 transmits the waste heat from the light source baseboard 20 to the power receiving base 3, and then the power receiving base 3 further dissipates the waste heat via thermal radiation or thermal conduction. As a result, electric current is prevented from flowing out from the heat sink 22 or circuit board 21 to achieve cooling and current-leakage prevention at the same time.

Also referring to FIG. 3, since the heat sink 22 is encased in the lamp shell 1 and power receiving base 3 without exposing, the LED light bulb is formed in a profile similar to that of the conventional tungsten light bulb, but has the light source baseboard 20 with multiple LEDs 4 mounted thereon held in the light transmissive portion 10 rather than tungsten filaments. The waste heat generated by the light source baseboard 20 is transmitted via the heat sink 22 to the power receiving base 3 for dissipating. The LED light bulb thus formed has many advantages, such as greater luminosity, lower electric power consumption and higher heat dissipation efficiency.

Figure 4:
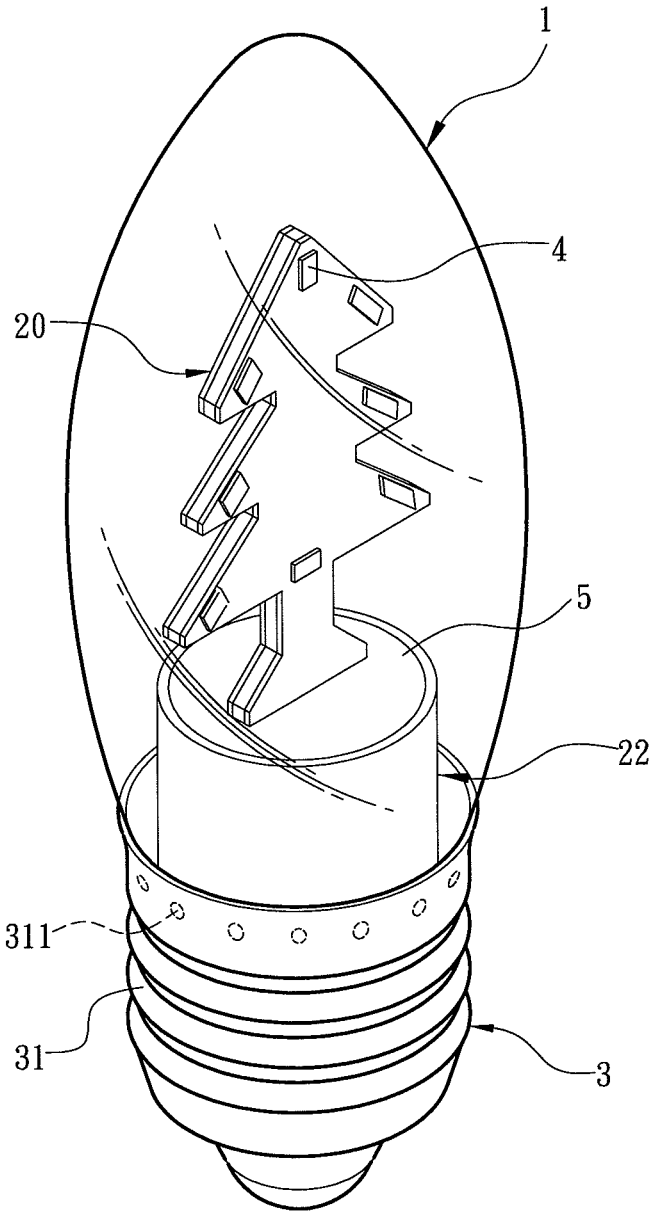
FIG. 4 is a perspective view of another embodiment of the light source baseboard of the invention.

The invention also provides another feature. The light source baseboard 20 can be formed in varying profiles according to different requirements, such as a star shape shown in FIG. 3, or a Christmas tree shown in FIG. 4, or other cute cartoon profiles, to offer more appeal to users. In a dim environment the light source baseboard 20 of diversified profiles can emit light in varying fashions. Moreover, since the light source baseboard 20 can hold the LEDs 4 on both sides in a distributed manner, the waste heat generated by the LEDs 4 can be sufficiently transmitted outside through the aluminum baseboard.

As a conclusion, the invention provides a light emitting assembly that includes a heat sink which can transmit waste heat generated by the light source baseboard via the thermal conductive plastics from the heat collecting section to the holding section, and allows the holding section to form connection with the inner surface of the power receiving base, the waste heat can be transmitted via the power receiving base for dissipating more efficient. Moreover, as the fastening portion of the power receiving base is formed slightly larger than the holding portion to encase thereof, and the power receiving base can encase the holding portion and also fully encase the heat sink without exposing simultaneously, thus the heat sink is fully encased in the lamp shell and power receiving base, current leakage of the LED light bulb via the heat sink can be averted. Furthermore, the light source baseboard has the conduction circuits laid on the two ends and can be formed in diversified profiles, once energized by electric power, the light emitting elements located thereon can emit light in various fashions. It provides significant improvements over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An LED light bulb providing high heat dissipation efficiency, comprising:

a lamp shell including a light transmissive portion and a holding portion with an opening located below the light transmissive portion;

a light emitting assembly including a light source baseboard located in the light transmissive portion and including at least one light emitting element located on the light source baseboard and a circuit board connecting to the light source baseboard, the circuit board being surrounded by a heat sink which includes a housing chamber to hold the circuit board; and a power receiving base which is electrically connected to the circuit board and includes a fastening portion to encase and fasten to the holding portion;

wherein the heat sink includes a heat collecting section located in the light transmissive portion and formed at an outer diameter smaller than an inner diameter of the holding portion and a holding section extended integrally from the heat collecting section into the power receiving base such that the power receiving base encases the holding portion and fully encases the heat sink without exposing simultaneously, the power receiving base including an inner surface connecting to an outer surface of the holding section of the heat sink so that heat generated by the light source baseboard is absorbed by the heat collecting section and transmitted via the holding section to the power receiving base for dissipating, wherein the light emitting assembly includes a circuit adapter located between the light source baseboard and the circuit board, and wherein the circuit adapter is coated with plastics on the surface thereof in contact with the light source baseboard and the heat collecting section.

2. The LED light bulb of claim 1, wherein the holding section is formed at an outer diameter greater than that of the heat collecting section, and the holding portion is extended towards the holding section to form a retaining section that is formed at an outer diameter the same as that of the holding section.

3. The LED light bulb of claim 1, wherein the light source baseboard is an aluminum baseboard including a plurality of conduction circuits.

4. The LED light bulb of claim 1, wherein the circuit adapter is coupled on an orifice formed at one side of the housing chamber of the heat sink.

5. The LED light bulb of claim 1, wherein the plastics are thermal conductive plastics.

6. The LED light bulb of claim 1, wherein the circuit board and the heat sink are interposed by plastics to prevent from forming conductive connection therebetween.

7. The LED light bulb of claim 6, wherein the plastics are thermal conductive plastics.

8. The LED light bulb of claim 1, wherein the light source baseboard includes a first surface and a second surface opposite to the first surface, the first surface and the second surface including a plurality of light emitting elements.

9. The LED light bulb of claim 8, wherein the light source baseboard includes a lateral surface connecting to the first surface and the second surface, the lateral surface including the plurality of light emitting elements.

10. The LED light bulb of claim 1, wherein the circuit board and the heat sink are interposed by an insulation bushing to prevent from forming conductive connection therebetween.

11. The LED light bulb of claim 1, wherein the heat sink is made of a material selected from the group consisting of aluminum, copper, on and graphite.

* * * * *